US006682409B2

(12) United States Patent
Cheng

(10) Patent No.: US 6,682,409 B2
(45) Date of Patent: Jan. 27, 2004

(54) WAFER CARRIER STRUCTURE FOR CHEMICAL-MECHANICAL POLISHER

(75) Inventor: Chi-Feng Cheng, Yuan-Lin Cheng (TW)

(73) Assignee: Macronix International Co., Ltd., Hsinchu (TW)

( * ) Notice: Subject to any disclaimer, the term of this patent is extended or adjusted under 35 U.S.C. 154(b) by 0 days.

(21) Appl. No.: 09/861,756

(22) Filed: May 21, 2001

(65) Prior Publication Data

US 2002/0173253 A1 Nov. 21, 2002

(51) Int. Cl.[7] ..... B24B 1/00

(52) U.S. Cl. ..... 451/286; 451/41; 451/60; 451/285; 451/287; 451/288; 451/289; 451/446

(58) Field of Search ..... 451/41, 60, 285, 451/287, 288, 289, 446

(56) References Cited

U.S. PATENT DOCUMENTS

| | | | | | |
|---|---|---|---|---|---|
| 5,782,675 | A | * | 7/1998 | Southwick | 451/56 |
| 6,347,979 | B1 | * | 2/2002 | Drill | 451/41 |
| 6,387,289 | B1 | * | 5/2002 | Wright | 216/88 |
| 6,406,361 | B1 | * | 6/2002 | Zuniga et al. | 451/287 |
| 6,425,810 | B2 | * | 7/2002 | Komuro | 451/289 |

* cited by examiner

*Primary Examiner*—Lee D. Wilson
*Assistant Examiner*—Shantese McDonald
(74) *Attorney, Agent, or Firm*—J.C. Patents

(57) ABSTRACT

A wafer carrier structure for a chemical-mechanical polishing device. The wafer carrier structure includes a holder and a slurry supply pipeline. The slurry supply pipeline is attached to the side of the holder such that a portion of the supply pipeline near the outlet end is either parallel or perpendicular to the sidewall of the holder.

7 Claims, 4 Drawing Sheets

WAFER CARRIER STRUCTURE FOR CHEMICAL-MECHANICAL POLISHER

BACKGROUND OF THE INVENTION

1. Field of Invention

The present invention relates to a chemical-mechanical polishing device. More particularly, the present invention relates to a wafer carrier structure for a chemical-mechanical polishing device.

2. Description of Related Art

Chemical-mechanical polishing is one of the principal techniques for global planarization. Chemical-mechanical polishing is a physical process of grinding using a polishing wheel with the assistance of a suitable chemical reagent so that all uneven profiles on a silicon wafer are universally flattened.

FIG. 1 is a schematic side view of a conventional chemical-mechanical polishing device. FIG. 2 is a schematic top view of the conventional chemical-mechanical polishing device shown in FIG. 1. As shown in FIGS. 1 and 2, the chemical-mechanical polishing device includes a polishing table 100, a wafer carrier 106 (alternatively called a polishing head), a polishing pad 102 and a slurry-supply pipe 110. The wafer carrier 106 is used to hold a wafer 104 and comprises a holder 105, a hole (not shown) to apply suction to the wafer 104 and a retaining ring to support the wafer 104. The polishing pad 102 is placed on the polishing table 100 and the slurry-supply pipe 110 are used to deliver slurry 110*a* to the polishing pad 102. To carry out a chemical-mechanical polishing, the polishing table 100 and the wafer carrier 106 rotate according to a set of preset directions. The wafer carrier 106 grasps the backside 104*a* of the wafer 104 and presses the front face 104*b* of the wafer 104 against the polishing pad 102. The slurry-supply pipe 110 continuously delivers slurry 110*a* to the polishing pad 102. Any protruding sections on the wafer react with the chemical reagents in the slurry 110*a*. The protruding sections are also bombarded by abrasive particles in the slurry 110*a* and scraped by the roughened surface of the polishing pad 102. Such chemical reaction and physical abrasion continues for some time until the entire wafer surface is planarized.

In a conventional chemical-mechanical polishing system, the wafer carrier and the slurry supply pipeline are separate components on the polishing table so that considerable space above the chemical-mechanical polishing table is occupied. Furthermore, distribution of slurry over the polishing pad by a conventional slurry supply pipeline is usually non-uniform.

SUMMARY OF THE INVENTION

Accordingly, one object of the present invention is to provide an integrated wafer carrier structure above the polishing table of a chemical-mechanical polishing device. The carrier structure incorporates a slurry supply pipeline so that the space above the polishing table is less cluttered.

A second object of this invention is to provide an integrated wafer carrier structure for a chemical-mechanical polishing device. The carrier structure incorporates a slurry supply pipeline so that fabrication and maintenance costs are reduced. A third object of this invention is to provide an integrated carrier wafer structure for a chemical-mechanical polishing device. The slurry supply pipeline incorporated with the carrier wafer structure is able to improve the distribution of slurry over the polishing pad of the polishing device.

To achieve these and other advantages and in accordance with the purpose of the invention, as embodied and broadly described herein, the invention provides a wafer carrier structure for a chemical-mechanical polishing device. The wafer carrier structure includes a holder and a slurry supply pipeline. The slurry supply pipeline is mounted on the side of the holder with the outlet of the pipeline pointing in a direction parallel to the sidewall of the holder.

This invention also provides an alternative carrier structure for a chemical-mechanical polishing device. The wafer carrier structure includes a holder and a slurry supply pipeline. The slurry supply pipeline is mounted on the side of the holder with the outlet of the pipeline pointing in a direction perpendicular to the sidewall of the holder.

In this invention, the wafer carrier and the slurry supply pipeline are integrated together. Hence, more space is available above the polishing table of the chemical-mechanical polisher. Furthermore, both fabrication cost and maintenance cost of the polisher are reduced and uniformity of slurry distribution over the polishing pad is improved.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
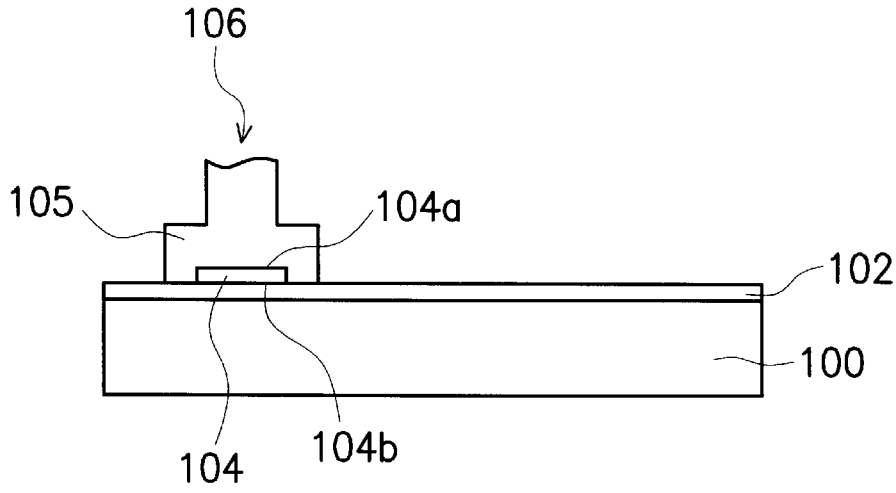
FIG. 1 (PRIOR ART)
FIG. 1 is a schematic side view of a conventional chemical-mechanical polishing device.
Figure 2:
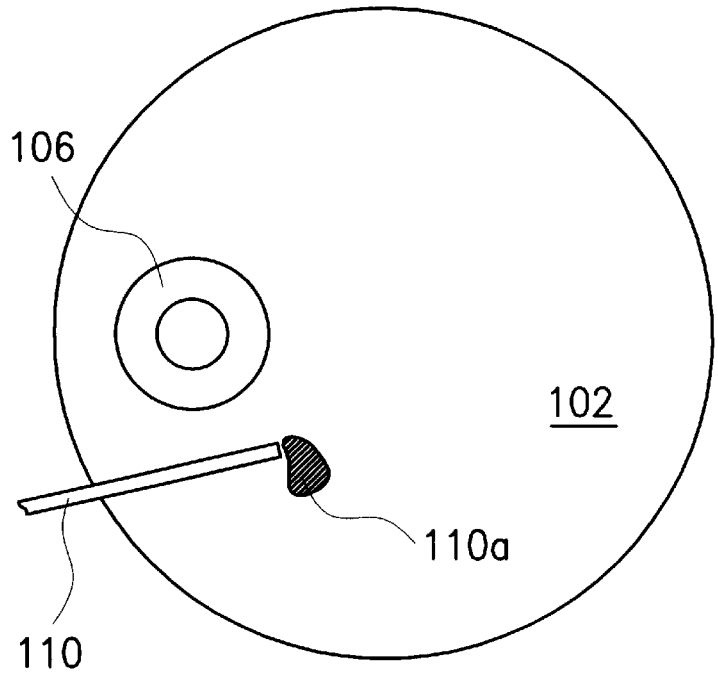
FIG. 2 (PRIOR ART)
FIG. 2 is a schematic top view of the conventional chemical-mechanical polishing device shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3:
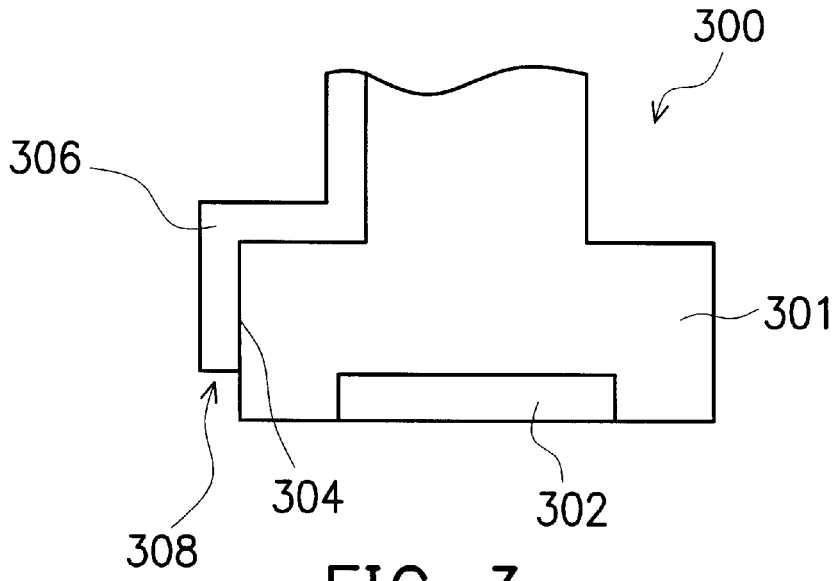
FIG. 3 is a schematic side view of the wafer carrier structure of a chemical-mechanical polisher fabricated according a first preferred embodiment of this invention.
Figure 3A:
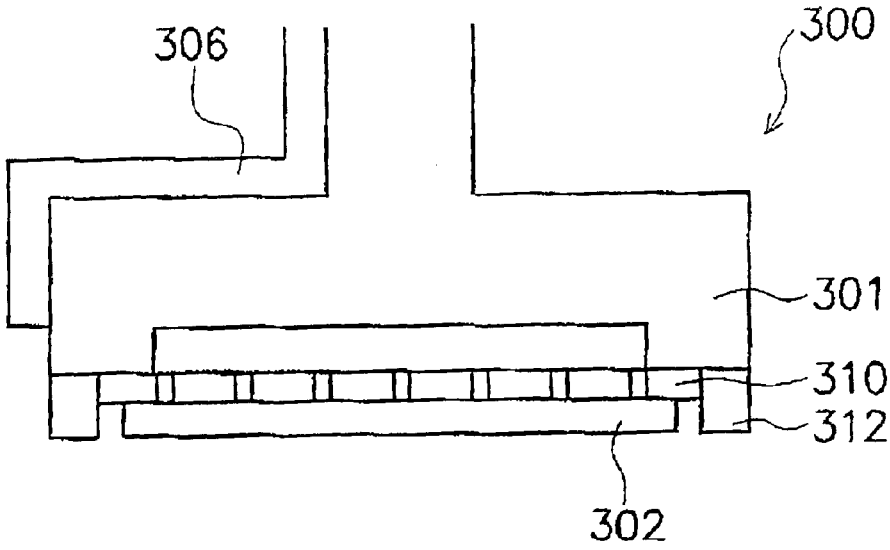
FIG. 3A is a schematic side view of the wafer carrier structure of the chemical-mechanical polisher according to the first preferred embodiment of this invention.
Figure 3B:
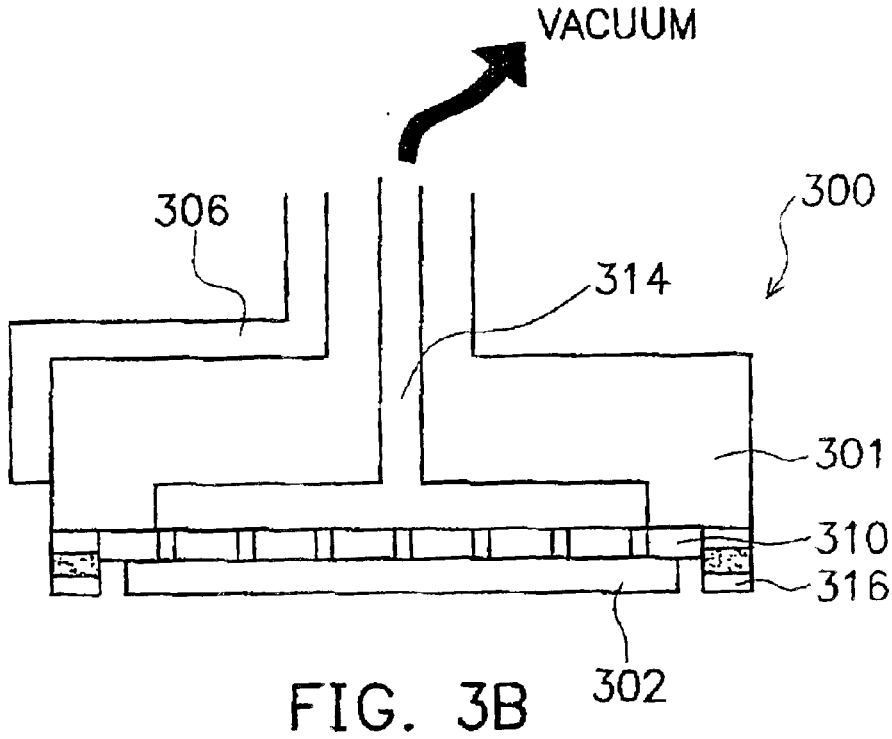
FIG. 3B is a schematic side view of the wafer carrier structure of the chemical-mechanical polisher according to the first preferred embodiment of this invention.

FIG. 3 is a schematic side view of the wafer carrier structure of a chemical-mechanical polisher fabricated according a first preferred embodiment of this invention. As shown in FIG. 3, a wafer carrier 300 comprising a slurry supply pipeline 306 is provided. The slurry supply pipeline 306 is mounted on the side of the holder 301. The outlet 308 of the pipeline 306 points in a direction parallel to the sidewall 304 of the holder 301. In other words, the slurry supply pipeline 306 extends downwards along the sidewall 304 of the holder 301 so that the outlet 308 points towards the polishing pad of the chemical-mechanical polisher. The holder 301 is made from rubber material, for example. As shown in FIG. 3A, the wafer carrier 300, for example, can be a wafer carrier with a flexible porous carrier film 310 attached so that a wafer 302 is able to be pressed and held stationary against a wetted carrier film. Furthermore, the edge of the holder 301 may include a retainer ring 312 for supporting the wafer 302. As shown in FIG. 3B, another type of wafer carrier 300 may includes a vacuum hole 314, for example. Using vacuum suction, the wafer 302 is attached to the holder 301 via the carrier film 310. During polishing, a small amount of gaseous nitrogen is introduced by providing a slight positive pressure to adjust the difference in polishing rates between the center and the periphery of the wafer. In addition, a floating retainer ring 316 may be used near the edge of the holder 301 so that stress created near the edge of the wafer 302 can be redistributed to the floating ring. A positive pressure may also be applied to the floating ring for closer contact with the polishing pad.

Figure 4:
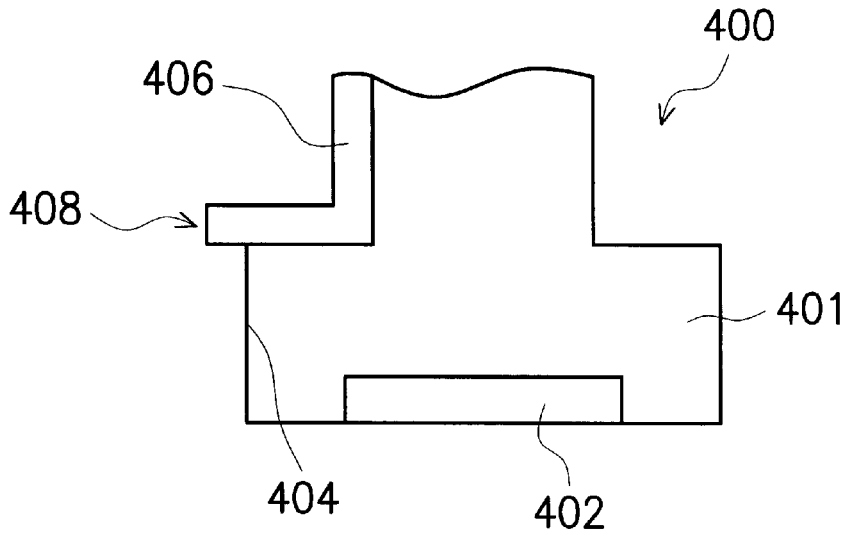
FIG. 4 is a schematic side view of the wafer carrier structure of a chemical-mechanical polisher fabricated according to a second preferred embodiment of this invention.
Figure 4A:
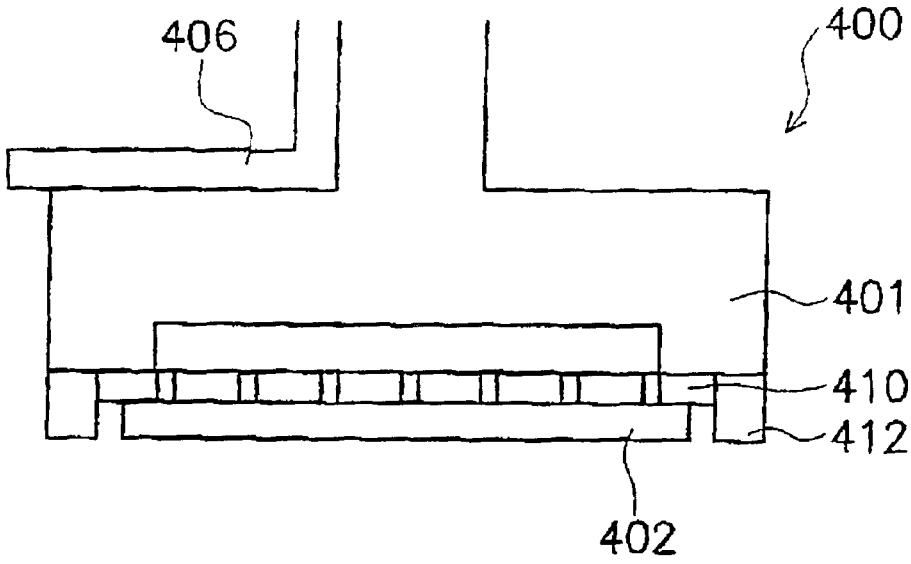
FIG. 4A is a schematic side view of the wafer carrier structure of the chemical-mechanical polisher according to the second preferred embodiment of this invention.
Figure 4B:
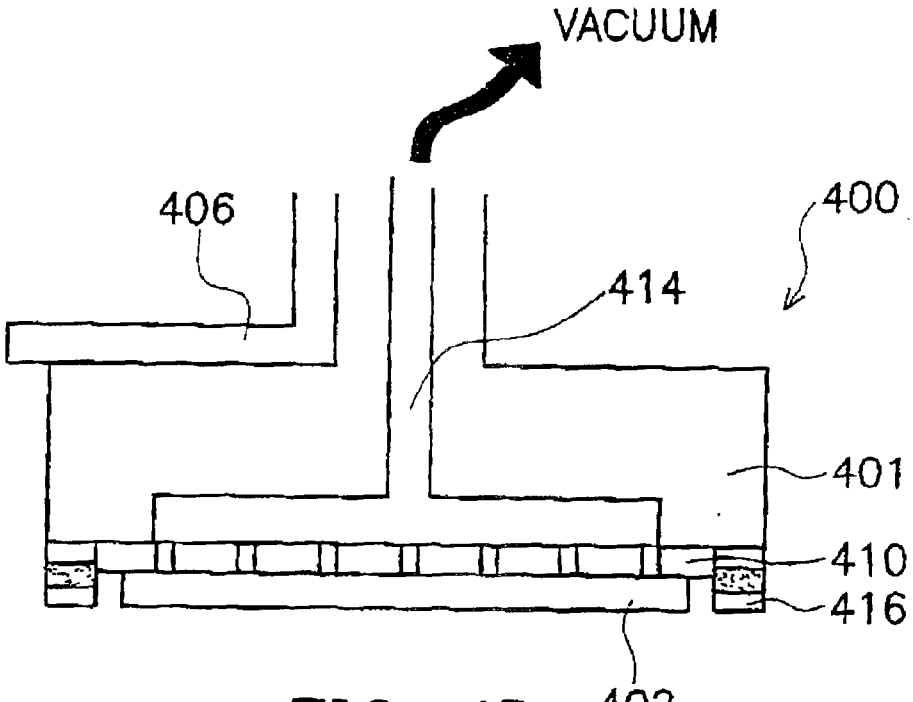
FIG. 4B is a schematic side view of the wafer carrier structure of the chemical-mechanical polisher according to the second preferred embodiment of this invention.

FIG. 4 is a schematic side view of the wafer carrier structure of a chemical-mechanical polisher fabricated according to a second preferred embodiment of this invention. As shown in FIG. 4, a wafer carrier 400 comprising of a holder 401 and a slurry supply pipeline 406 is provided. The slurry supply pipeline 406 is mounted on the side of the holder 401. The outlet 408 of the pipeline 406 points in a direction perpendicular to the sidewall 404 of the holder 401. Hence, the outlet 408 of the pipeline 406 and the polishing pad of the polisher are parallel to each other. The holder 401 is made from rubber material, for example. As shown in FIG. 4A, the wafer carrier 400, for example, can be a wafer carrier with a flexible porous carrier film 410 attached so that a wafer 402 is able to be pressed and held stationary against a wetted carrier film. Furthermore, the edge of the holder 401 may include a retainer ring 412 for supporting the wafer 402. As shown in FIG. 4B, another type of wafer carrier 400 may includes a vacuum hole 414, for example. Using vacuum suction, the wafer 402 is attached to the holder 401 via the carrier film 410. During polishing, a small amount of gaseous nitrogen is introduced by providing a slight positive pressure to adjust the difference in polishing rates between the center and the periphery of the wafer. In addition, a floating retainer ring 416 may be used near the edge of the holder 401 so that stress created near the edge of the wafer 402 can be redistributed to the floating ring. A positive pressure may also be applied to the floating ring for closer contact with the polishing pad.

In a polishing operation, slurry is delivered to the polishing pad via the slurry supply pipeline 406. Since the wafer carrier 400 rotates in a pre-defined direction during polishing, a uniform distribution of slurry on the polishing pad is produced.

In this invention, the slurry supply pipeline is attached to the side of the holder such that slurry may be ejected from the pipeline in a direction parallel to the holder sidewall or perpendicular to the holder sidewall.

In summary, the advantages of this invention includes:

1. The integration of the wafer carrier and the slurry supply pipeline frees up more space above the polishing table of the chemical-mechanical polisher.
2. The integration of the wafer carrier and the slurry supply pipeline reduces both fabrication cost and maintenance cost of the polisher.
3. The integration of the wafer carrier and the slurry supply pipeline improves the distribution of slurry over the polishing pad.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wafer carrier structure for a chemical-mechanical polishing device, comprising:

a holder for supporting a silicon wafer; and a slurry supply pipeline attached to a side of the holder, wherein a direction of the slurry supply pipeline near an outlet end thereof is parallel to a sidewall of the holder.

2. The wafer carrier structure of claim 1, wherein the slurry supply pipeline extends downward such that the outlet end of the slurry supply pipeline is facing a polishing pad of the chemical-mechanical polishing device.

3. The wafer carrier structure of claim 1, wherein material forming the holder includes rubber.

4. The wafer carrier structure of claim 1, wherein the wafer carrier structure further includes a vacuum hole for gripping the silicon wafer through suction.

5. The wafer carrier structure of claim 4, wherein the wafer carrier structure further includes a retainer ring attached to edges of the holder for supporting the wafer.

6. The wafer carrier structure of claim 1, wherein the wafer carrier structure further includes a cater film for fixing the wafer onto the holder.

7. The wafer cater structure of claim 6, wherein the wafer cater structure further includes a floating retainer ring affixed to an edge of the holder for supporting the wafer and transferring away from the wafer a portion of stress at an edge of the wafer.

* * * * *